US009228791B2

(12) United States Patent
Saunders

(10) Patent No.: US 9,228,791 B2
(45) **Date of Patent: *Jan. 5, 2016**

(54) ARCHERY BOW AND BOWSTRING DAMPENER

(71) Applicant: Charles A. Saunders, Columbus, NE (US)

(72) Inventor: Charles A. Saunders, Columbus, NE (US)

( * ) Notice: Subject to any disclaimer, the term of this patent is extended or adjusted under 35 U.S.C. 154(b) by 189 days.

This patent is subject to a terminal disclaimer.

(21) Appl. No.: 13/947,740

(22) Filed: Jul. 22, 2013

(65) Prior Publication Data

US 2014/0014083 A1 Jan. 16, 2014

Related U.S. Application Data

(63) Continuation-in-part of application No. 13/040,071, filed on Mar. 3, 2011, now Pat. No. 8,567,381.

(60) Provisional application No. 61/674,387, filed on Jul. 22, 2012, provisional application No. 61/310,124, filed on Mar. 3, 2010.

(51) Int. Cl.

| | |
|---|---|
| ***F41B 5/14*** | (2006.01) |
| ***F41B 5/12*** | (2006.01) |
| ***F41B 5/10*** | (2006.01) |

(52) U.S. Cl.

CPC ..... *F41B 5/1426* (2013.01); *F41B 5/10* (2013.01); *F41B 5/123* (2013.01); *F41B 5/1407* (2013.01)

(58) Field of Classification Search

CPC ..... F41B 5/10; F41B 5/123; F41B 5/1407; F41B 5/1426

See application file for complete search history.

(56) References Cited

U.S. PATENT DOCUMENTS

| | | | | |
|---|---|---|---|---|
| 3,342,172 | A | 9/1967 | Sanders | |
| 5,137,318 | A | 8/1992 | Lohman | |
| 5,452,704 | A | 9/1995 | Winebarger | |
| 5,720,269 | A * | 2/1998 | Saunders | 124/86 |
| 6,382,201 | B1 | 5/2002 | McPherson | |
| 6,499,478 | B1 * | 12/2002 | Perez | 124/86 |
| 6,543,432 | B2 | 4/2003 | Andrews et al. | |
| 6,634,348 | B2 | 10/2003 | Gallops, Jr. | |
| 6,684,870 | B1 | 2/2004 | Land | |
| 6,966,314 | B2 | 11/2005 | McPherson | |
| 7,703,449 | B2 | 4/2010 | Wright | |
| 7,954,481 | B2 | 6/2011 | Barnard | |
| 2002/0152662 | A1 | 10/2002 | Lane et al. | |
| 2004/0077440 | A1 * | 4/2004 | Kronfeld | 473/578 |
| 2006/0009783 | A1 | 1/2006 | Bates et al. | |
| 2008/0264400 | A1 * | 10/2008 | Wright | 124/89 |
| 2009/0000606 | A1 * | 1/2009 | Cooper et al. | 124/25.6 |
| 2010/0192931 | A1 * | 8/2010 | Brewster | 124/89 |
| 2010/0319669 | A1 * | 12/2010 | Grace, Jr. | 124/88 |
| 2011/0214656 | A1 | 9/2011 | Saunders | |
| 2014/0041645 | A1 * | 2/2014 | Wasilewski et al. | 124/25.6 |
| 2015/0013657 | A1 * | 1/2015 | Kempf | 124/88 |

* cited by examiner

*Primary Examiner* — Gene Kim
*Assistant Examiner* — John E Simms, Jr.
(74) *Attorney, Agent, or Firm* — Levenfeld Pearlstein, LLC

(57) ABSTRACT

An archery bow and bowstring dampener is disclosed. The dampener comprises at least one sleeve and at least one piston. The sleeve is formed with a first end adapted attached to a bow and a second end with at least one flared arm extending therefrom. Each sleeve is configured to matingly receive at least one piston therein. Each piston has at least one gripper extending therefrom on one end. The grippers flare outwardly from each piston and are mounted to each piston such that the grippers move inwardly when impacted by the bow limb(s) and/or bowstring and when each piston enters its sleeve, thereby grasping the bow limb(s) and/or bowstring, and outwardly when each piston exits its sleeve, thereby releasing the bow limb(s) and/or bowstring.

20 Claims, 21 Drawing Sheets

ARCHERY BOW AND BOWSTRING DAMPENER

CROSS REFERENCE TO RELATED APPLICATIONS

This application claims the benefit of U.S. Provisional Application No. 61/674,387, filed on Jul. 22, 2012, and is a continuation-in-part of U.S. application Ser. No. 13/040,071, filed on Mar. 3, 2011, which claims the benefit of U.S. Provisional Application No. 61/310,124, Mar. 3, 2010.

BACKGROUND OF THE INVENTION

The present invention relates generally to archery bows and their components and accessories. More particularly, the present invention relates to an apparatus for dampening the vibration of a bowstring to reduce the sound produced by the bowstring during the release of the bowstring when shooting the bow, as well as, in some embodiments, for dampening the vibration of the bow limb (or bow limbs) to reduce the sound produced by the limb(s) when the bow is shot.

As recognized by those skilled in the art, a bowstring on an archery bow will produce a characteristic noise upon release of the bowstring to launch an arrow. This characteristic noise is associated with the vibrational pattern created by the bowstring, and is colloquially referred to as a "twang."

In addition to the sound produced by the bowstring, the bow itself, or, more precisely, the bow limb(s), also may produce a sound when the bowstring is released. This sound is created as the tensioned limb(s) snap back towards a "dead" or "static" (or "neutral") position and resonate until movement of the limb(s) ceases. Any bow can produce such a sound, but compound bows, in particular, can be highly susceptible.

While theses sounds do not affect the accuracy of a shot, the sounds travel faster than the arrow and, therefore, the sounds may startle the target and reduce the likelihood of an accurate hit. There have been numerous solutions proposed to these problems, many of them basing their effectiveness on the attachment of some device to the bow (the handle/riser and/or the limbs) and/or the bowstring to "interfere" with the oscillating movement of the bow limb(s) and/or the bowstring and thereby reduce the associated noises created by the bow limb(s) and/or the bowstring.

For example, U.S. Pat. No. 5,720,269, issued to Saunders, discloses a bowstring sound dampener having a support arm with one end mounted to a bow, and a cushion member on a second end of the support. The cushion member is formed of a resilient material which absorbs the energy of movement of the bowstring upon release of the bowstring after launching an arrow, thereby dampening the sound emitted by the string.

In another example, United States Patent Application Publication No. US2011/0214656, published on Sep. 8, 2011, and concurrently owned with the present application, discloses a Bowstring Sound Dampener having a sleeve and piston with grippers that at least partially surround a bowstring when the piston moves into the sleeve. This design results in numerous advantages as described in the patent application, and the contents of the patent application are incorporated herein by reference.

U.S. Pat. No. 6,966,314, issued to McPherson, discloses a limb-mounted bowstring vibration and noise suppressor. The vibration and noise suppressor is carried by a support having an attachment device at one end for attaching the suppressor to a limb of a bow.

In yet another example, U.S. Pat. No. 6,543,432, issued to Andrews et al., discloses an archery bow having at least one dampener configured to reduce noise and vibration of the bow. The dampener is connected to a limb or to a riser or handle portion of the bow to reduce vibrations transferred to the riser by the limb.

Additional examples of bow limb dampening devices are found in: United States Patent Application Publication No. US2004/0077440 for an Archery Bow Limb Construction With or Without Built In Limb Dampeners by Kronfeld; U.S. Pat. No. 6,684,870, issued to Land, for a Split Limb Archery Bow Apparatus; U.S. Pat. No. 3,342,172, issued to Sanders, for an Archery Bow Limb Shock Cushioning Means Having a Bracket with Pivotally Mounted Weighted Extended Arms; U.S. Pat. No. 6,382,201, issued to McPherson et al., for a Bow Vibration Dampener; and, U.S. Pat. No. 7,703,449, issued to Wright, for Limb Dampeners.

Each of the patents and published patent applications identified in the preceding paragraph generally disclose devices that attach to, or that are formed integral with, the bow limb(s), and that are designed to dampen the movement or vibration of the bow limb(s) to improve the performance and longevity of the bow and, in some cases, to reduce the noise produced by the bow upon release of the arrow.

While the preceding prior art devices perform well, they generally involve the bowstring and/or the bow limb(s) impacting a relatively immobile surface, thereby creating additional noise when the bowstring and/or bow limb(s) impact the surface, or they generally result only in resonant movement of the bowstring and/or bow limb(s) being reduced or slowed, but not eliminated or nearly eliminated.

Therefore, what is needed is a archery bow and bowstring dampening device that offers not only an improved ability to trap the bow limb(s) and/or the bowstring to prevent the bow limb(s) and/or the bowstring from oscillating after the shot and creating unwanted noise, but that also reduces the noise created upon impact of the bow limb(s) and/or bowstring, thereby providing additional benefit. The claimed dampener invention satisfies this need.

BRIEF SUMMARY OF THE INVENTION

The claimed apparatus dampens the vibration of the bow limb(s) and/or bowstring of an archery bow to thereby eliminate (or at least significantly reduce) the sound produced during the release of an arrow.

Specifically, the claimed archery bow and bowstring dampener comprises a sleeve and at least one piston. In a first embodiment, particularly useful for dampening bowstrings (but also adaptable to dampen bow limbs), the sleeve is generally cylindrical in shape with a frustoconical first end adapted to threadedly receive a mounting rod for connecting the bowstring sound dampener to a bow. The sleeve comprises a second end which is flared outwardly with a pair of generally V-shaped grooves formed diametrically therein creating a pair of diametrically opposed arms. The sleeve is configured to matingly receive the piston in a cavity formed therein.

In this first embodiment, the piston is formed as a generally cylindrical member having a pair of grippers extending therefrom on one end. The grippers flare outwardly from the piston in a diametrically opposed configuration. A groove is formed at the intersection of the grippers, the groove configured to receive and retain the bowstring after the drawn bowstring is released. The grippers are flexibly or pivotally mounted to the piston such that the grippers may move inwardly, towards one another, when the piston enters the sleeve. The grippers are biased outwardly, such that the grippers move outwardly, away from one other, when the piston exits the sleeve.

In a second embodiment of the claimed archery bow and bowstring dampener, particularly useful for dampening bow limbs (but also adaptable to dampen bowstrings), the sleeve generally is rectangular in shape with a generally flat first end adapted to attach to a mounting bracket for connecting the dampener to a bow. The sleeve comprises a second end that is flared outwardly with a pair of generally rectangularly shaped grooves formed on opposing sides of the sleeve thereby creating a pair of opposed arms. The sleeve is configured to matingly receive the piston in a cavity formed therein.

In this second embodiment, the piston is formed as a generally rectangular box-shaped member having a pair of grippers extending therefrom on one end. The grippers flare outwardly from the piston in an opposed configuration. A groove is formed between the grippers, the groove configured to receive and retain the bow limb(s) after the arrow is released. The grippers are flexibly or pivotally mounted to the piston such that the grippers may move inwardly, towards one another, when the piston enters the sleeve. The grippers are biased outwardly, such that the grippers move outwardly, away from one other, when the piston exits the sleeve.

In a third embodiment of the claimed archery bow and bowstring dampener, related to the second embodiment discussed above and also particularly useful for dampening bow limbs (but also adaptable to dampen bowstrings), the sleeve generally is rectangular in shape with a generally flat first end adapted to attach to a mounting bracket for connecting the dampener to a bow. Unlike the first and second embodiments in which the sleeve comprises a single cavity in which a single piston is disposed, the sleeve in the third embodiment comprises two integrated cavities in which two pistons are disposed (particularly useful for split limb bows). Each of the cavities of the sleeve is flared outwardly at the second end of the sleeve, with a pair of generally rectangularly shaped grooves formed on opposing sides of each cavity thereby creating two pairs of opposed arms. The sleeve is configured to matingly receive two pistons in the cavities formed therein.

In this third embodiment, the pistons are formed as generally rectangular box-shaped members each having a pair of grippers extending therefrom on one end. The grippers flare outwardly from the piston in an opposed configuration. A groove is formed between each pair of grippers, the grooves configured to receive and retain each of the two arms of a split bow limb after the arrow is released. The grippers are flexibly or pivotally mounted to the pistons such that the grippers may move inwardly, towards one another, when the pistons enter the cavities formed in the sleeve. The grippers are biased outwardly, such that the grippers move outwardly, away from one other, when the pistons exit the cavities formed in the sleeve.

In a fourth embodiment of the claimed archery bow and bowstring dampener, related to the third embodiment discussed above and also particularly useful for dampening bow limbs (but also adaptable to dampen bowstrings), the dampener comprises two discreet sleeves disposed at a distance from one another (particularly useful for use with split limb bows). Each sleeve generally is rectangular in shape with a first end adapted to attach to a mounting bracket for connecting the dampener to a bow. Each of the sleeves is flared outwardly at one side of the second end of the sleeve. Each sleeve is configured to matingly receive a piston in the cavity formed therein.

In this fourth embodiment, the pistons are formed as generally rectangular box-shaped members each having a single gripper extending therefrom on one end. Each gripper flares outwardly from the piston in the direction in which its sleeve is flared. A planar surface is formed adjacent to each gripper, each planar surface configured to engage one arm of the two arms of a split bow limb after the arrow is released. The grippers are flexibly or pivotally mounted to the pistons such that the grippers may move inwardly, towards one another, when the pistons enter the cavities formed in the sleeves. The grippers are biased outwardly, such that the grippers move outwardly, away from one other, when the pistons exit the cavities formed in the sleeves.

The claimed archery bow and bowstring dampener may be mounted to the bow in various locations and at multiple locations (such as on the handle, at the top and/or bottom of the bow, or elsewhere) using various means (such as directly or through mounts, brackets and/or other means).

Additionally, the claimed archery bow and bowstring dampener may be positioned such that the bowstring and/or the bow limb(s) are in contact with the dampener when the bowstring and/or the bow limb(s) are in the static (or neutral) position or such that the bowstring and/or the bow limb(s) are not in contact with the dampener when the bowstring and/or the bow limb(s) are in the static (or neutral) position.

Further, the sleeve and piston geometries may be altered without departing from the scope of the present disclosure in order to accommodate other sizes, types and shapes of bowstrings and/or the bow limbs.

These and other features and advantages of the claimed archery bow and bowstring dampener will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
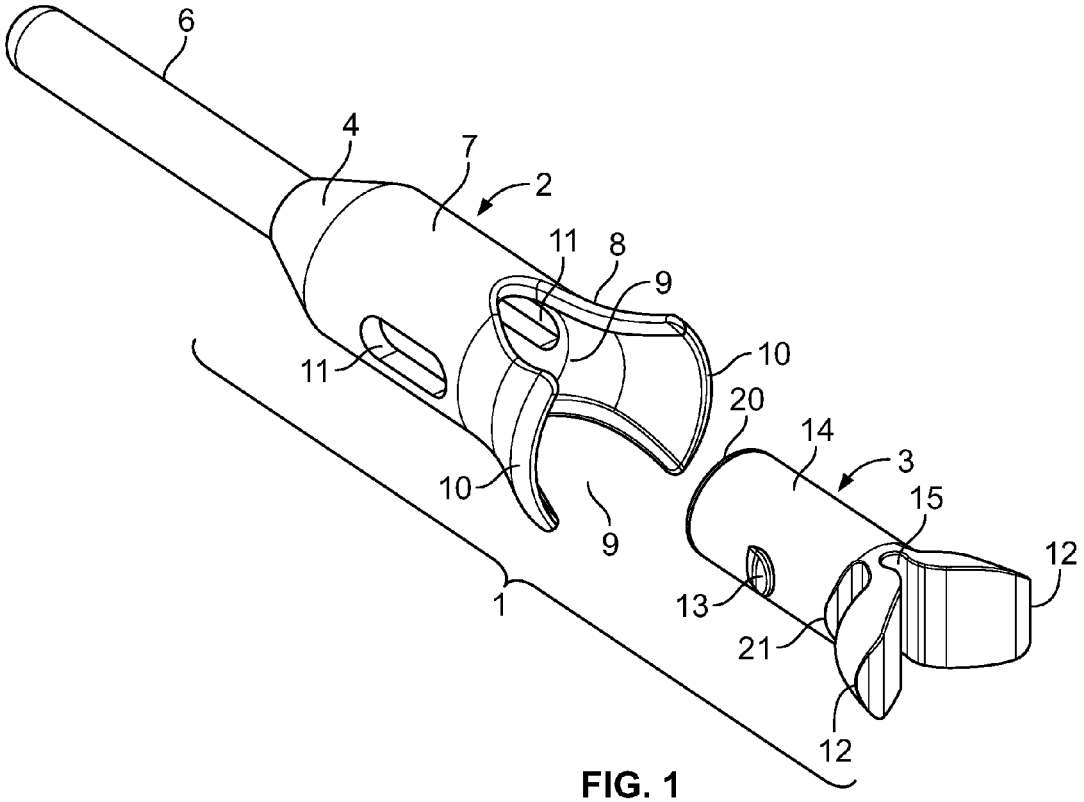
FIG. 1 is a perspective partially exploded view of the first embodiment of a bow and bowstring dampener embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

FIGS. 1-32 illustrate the claimed bow and bowstring dampener.

In a first embodiment particularly useful for dampening a bowstring, as shown in FIGS. 1-12, the dampener 1 comprises a sleeve 2 and a piston 3. Sleeve 2 is comprises a hollow, generally cylindrical central portion 7 having a frustoconical first end 4 and an outwardly flared second end 8. In this first embodiment, sleeve 2 is a comprised of a rigid, lightweight material, such as aluminum, plastic or other materials known in the art.

First end 4 is configured with a threaded bore 5 extending therethrough and configured to matingly and threadedly receive a threaded mounting rod 6 for connecting dampener 1 to a bow (not shown). It will be appreciated by those skilled in the art that the connection means can vary such that mounting rod 6 need not be threadedly connected to sleeve 2, but may be connected in any other suitable manner such that dampener 1 is attached to mounting rod 6, such as by friction fit or other means.

It also will be appreciated by those skilled in the art that claimed dampener 1 may be mounted to the bow in any suitable location, including the handle (or riser), the bow limb(s) or in any other locations or manners such that dampener 1 lies in the path of the bowstring after the drawn bowstring is released. This may include movable attachment means whereby dampener 1 is initially disposed outside of the path of the bowstring before the drawn bowstring is released, but is moved into the path of the bowstring after the drawn bowstring is released. This also may include mounting multiple dampeners 1 at various locations on the bow.

Additionally, mounting rod 6 may be permanently or removably affixed to the bow.

In the first embodiment, outwardly flared end 8 of sleeve 2 is formed with a pair of diametrically opposed generally V-shaped grooves 9 extending from outwardly flared end 8 towards central portion 7. V-shaped grooves 9 are configured to permit the bowstring to pass through outwardly flared end 8 after the drawn bowstring is released, as further discussed and described below.

V-shaped grooves 9 form a pair of diametrically opposed arms 10 at outwardly flared end 8, the distance between arms 10 decreasing such that the distance between arms 10 is greater closer to outwardly flared end 8 than the distance between arms 10 closer to central portion 7. In this manner, arms 10 are configured to receive piston 3 and cause grippers 12 of piston 3 to contract inwardly around the bowstring after the drawn bowstring is released, as further discussed and described below (such inward movement of grippers 12 also can result from the impact or interaction of the bowstring 16 with piston 3, the force of which may cause grippers 12 to move inwardly, towards one another, independent of the interaction between piston 3 and arms 10, as further discussed below).

In this embodiment, central portion 7 of sleeve 2 further comprises a pair of diametrically opposed slots 11 formed therein. Slots 11 are configured to matingly engage a pair of diametrically opposed studs 13 formed on piston 3 in order to guide piston 3 within sleeve 2 and to limit the movement of piston 3 within sleeve 2.

Piston 3 is formed as a generally cylindrical member having a diameter slightly less than the inner diameter of central portion 7 of sleeve 2, such that piston 3 may slidably move within sleeve 2, preferably with only a slight degree of frictional engagement between piston 3 and sleeve 2. Piston 3 preferably is formed of a resilient material capable of holding its shape, but also capable of absorbing the force of the released bowstring and cushioning or deadening the movement of the released bowstring. Such material may include various rubbers or elastomers as are well known to those skilled in the art.

In this embodiment, piston 3 comprises a cylindrical portion 14 and a pair of diametrically opposed grippers 12 formed integral with cylindrical portion 14 and extending from one end thereof. Cylindrical portion 14 further comprises a pair of diametrically opposed studs 13, discussed above, configured to matingly engage slots 11 formed in sleeve 2. In this manner, the movement of piston 3 within sleeve 2 may be advantageously controlled and limited by the movement of studs 13 within slots 11.

In other embodiments of dampener 1 of the present invention, the movement of piston 3 within sleeve 2 may be alternatively, or additionally, controlled by permitting mounting rod 6 to be threadedly inserted into sleeve 2 such that the end of mounting rod 6 extends into the body of sleeve 2 sufficiently to interfere with the movement of piston 3, thereby creating a variable movement limiter (i.e., providing a stop past which piston 3 may not travel within sleeve 2).

In yet other embodiment of dampener 1, the movement of piston 3 within sleeve 2 may be alternatively, or additionally, controlled by including a resilient stop member or bottoming pad (not shown) within sleeve 2. In this manner, the stop member would serve to limit the distance piston 3 may travel within sleeve 2 and, at the same time, would advantageously absorb some of the force of piston 3 upon impact of piston 3 with the stop member.

It also will be appreciated by those skilled in the art that an air pocket may be formed within sleeve 2 between the end of piston 3 and the first end 4 of sleeve 2. In this manner, the air pocket also can help dampen and control movement of piston 3 within sleeve 2.

As mentioned above, in this embodiment of dampener 1, piston 3 comprises a pair of diametrically opposed grippers 12 formed at one end of cylindrical portion 14 of piston 3 and extending outwardly therefrom. Preferably, grippers 12 flare outwardly from piston 3 in a diametrically opposed configuration and the inner surfaces of grippers 12 are formed with a curved profile. In this manner, grippers 12 provide a wide target to receive the released bowstring and to guide the bowstring toward the intersection of grippers 12.

In this embodiment, a groove 15 is formed at the intersection of grippers 12, groove 15 being configured to receive and retain the bowstring after the drawn bowstring is released. Preferably, groove 15 has a generally semi-circular profile when grippers 12 are open (or apart from one another) and a generally circular profile when grippers 12 are closed (or adjacent to one another). When grippers 12 are closed, groove 15 preferably has a diameter approximately equal to, or slightly less than, the diameter of the bowstring. In this manner, the bowstring may be firmly held within groove 15 after the bowstring is released.

In this embodiment, grippers 12 are flexibly or pivotally mounted to cylindrical portion 14 of piston 3 such that grippers 12 may move inwardly, towards one another. Such inward movement of grippers 12 can result from impact or interaction of the bowstring 16 with piston 3, the force of which may cause grippers 12 to move inwardly, towards one another. In addition, when piston 3 enters the sleeve, grippers 12 also are urged to move towards one another by arms 10. Such a configuration acts a failsafe, ensuring that grippers 12 move towards one another whether through the forces generated by the impact of bowstring 16 and/or the interaction with arms 10 of sleeve 2. Preferably, grippers 12 are biased outwardly, such that grippers 12 move outwardly, away from one other, when piston 3 exits sleeve 2.

Figure 2B:
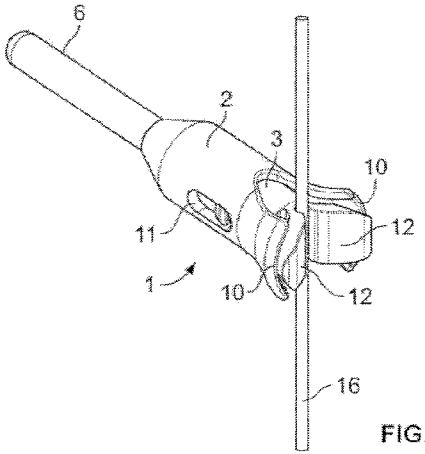
FIGS. 2A-2C are perspective views showing the operation of the dampener of FIG. 1.
Figure 2C:
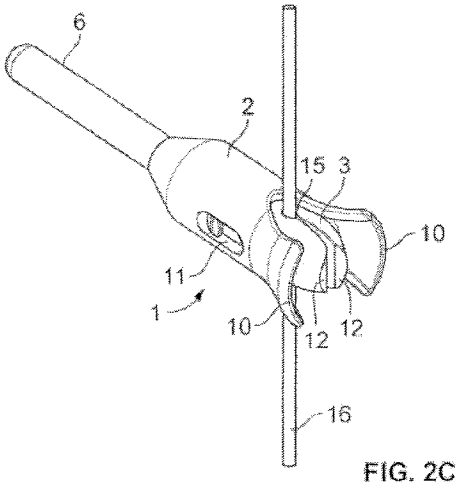
Figure 2A:
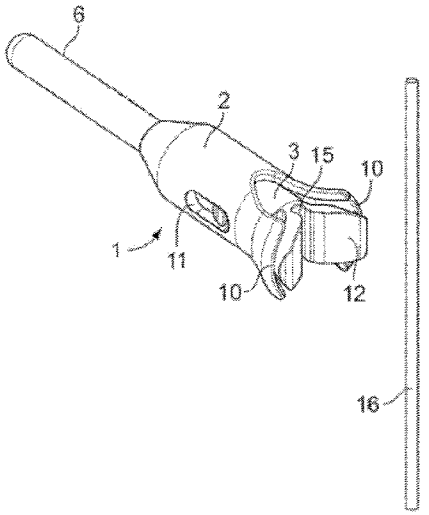
Figure 3:
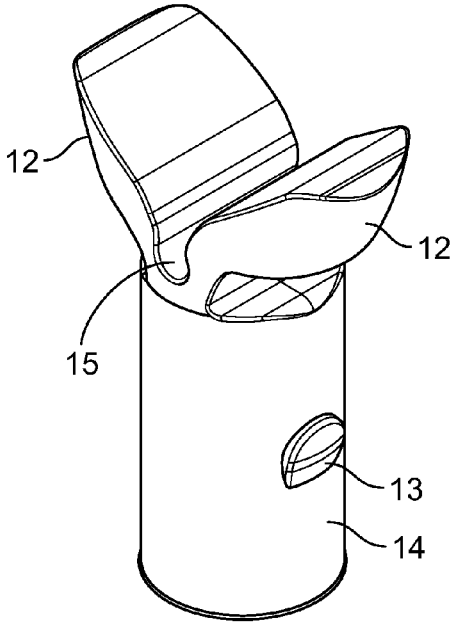
FIG. 3 is an enlarged perspective view of the piston of the dampener of FIG. 1.
Figure 4:
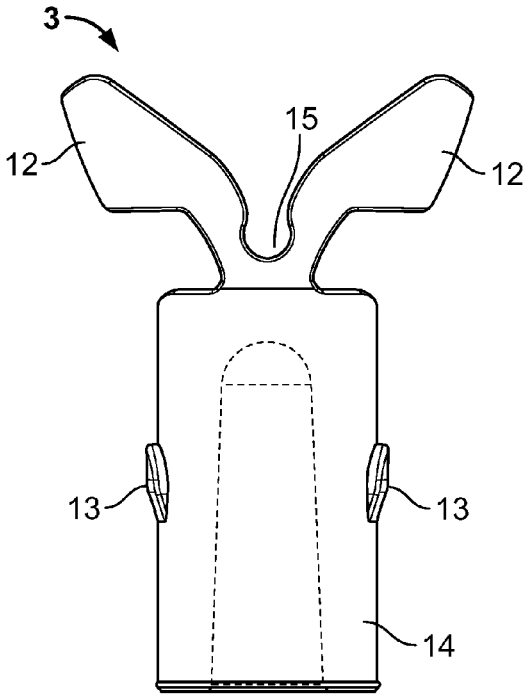
FIG. 4 is an enlarged front view of the piston of the dampener of FIG. 1.
Figure 5:
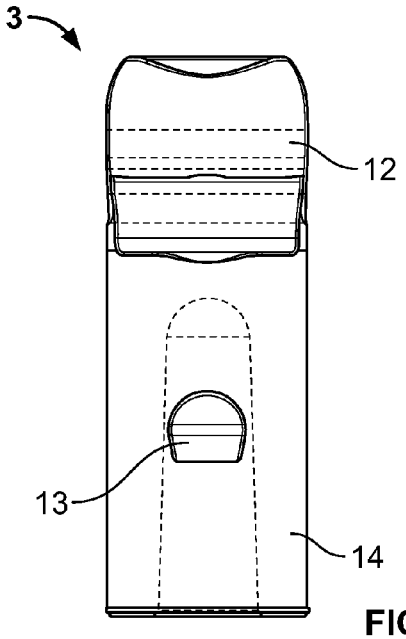
FIG. 5 is an enlarged side view of the piston of the dampener of FIG. 1.
Figure 8:
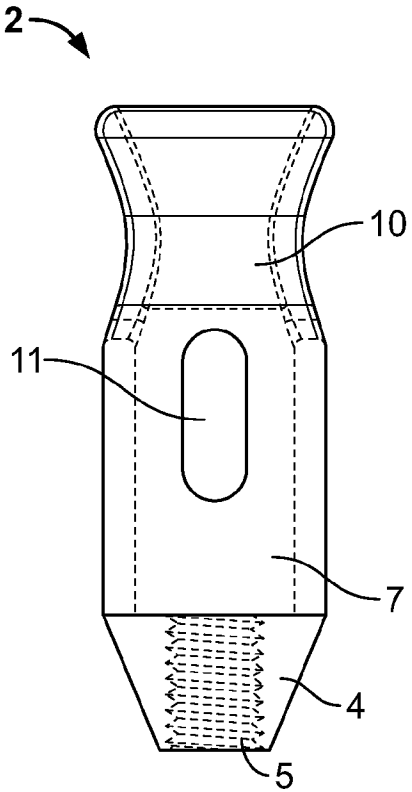
FIG. 8 is an enlarged side view of the sleeve of the dampener of FIG. 1.
Figure 7:
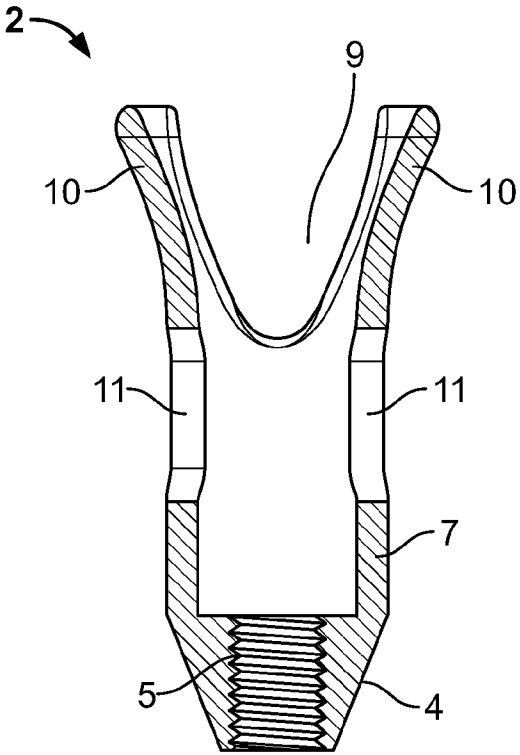
FIG. 7 is an enlarged cross-sectional side view of the sleeve of the dampener of FIG. 1.
Figure 6:
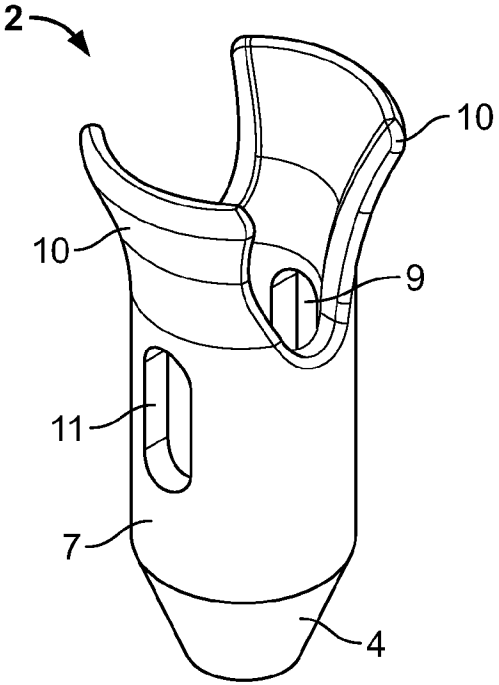
FIG. 6 is an enlarged perspective view of the sleeve of the dampener of FIG. 1.
Figure 12:
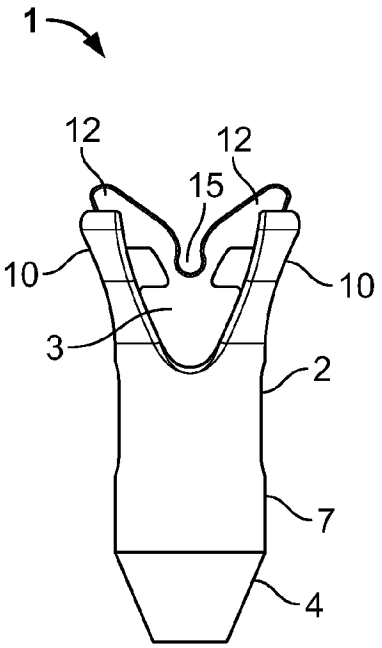
FIG. 12 is a front view of the assembled dampener of FIG. 1.
Figure 11:
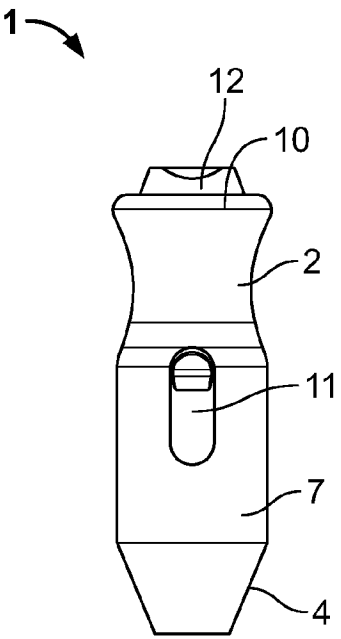
FIG. 11 is a side view of the assembled dampener of FIG. 1.
Figure 10:
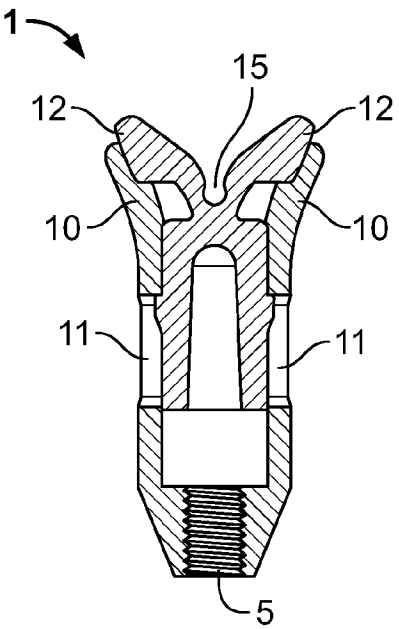
FIG. 10 is a cross-sectional front view of the assembled dampener of FIG. 1.
Figure 9:
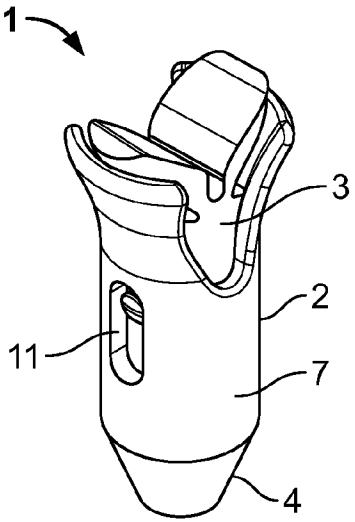
FIG. 9 is a perspective view of the assembled dampener of FIG. 1.
Figure 13:
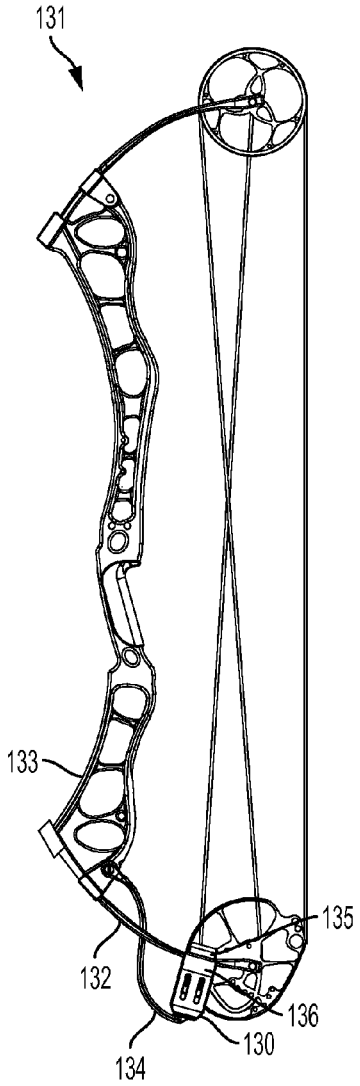
FIG. 13 is side view of another embodiment of a bow and bowstring dampener embodying the principles of the present invention as mounted to a split limb compound bow.
Figure 14:
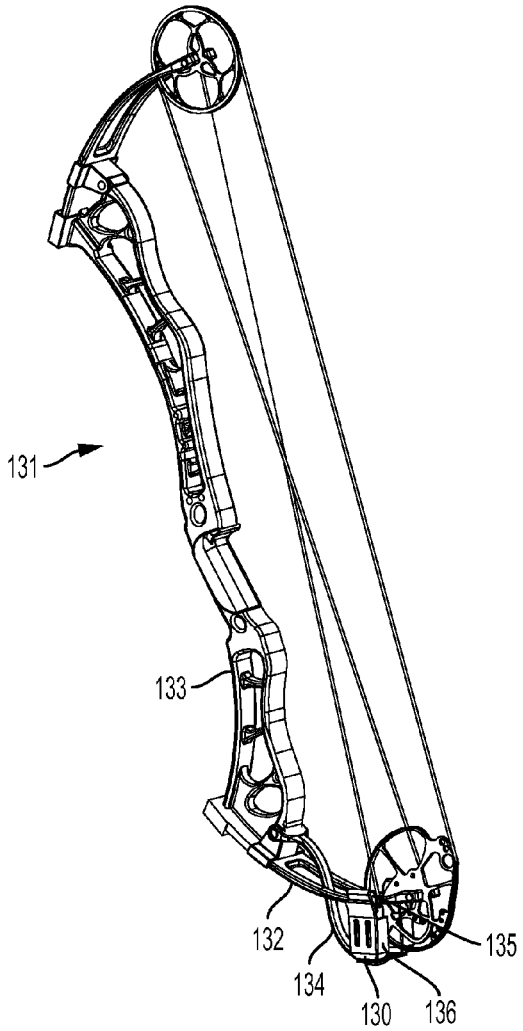
FIG. 14 is a perspective of the dampener of FIG. 13 mounted to the split limb compound bow.
Figure 15:
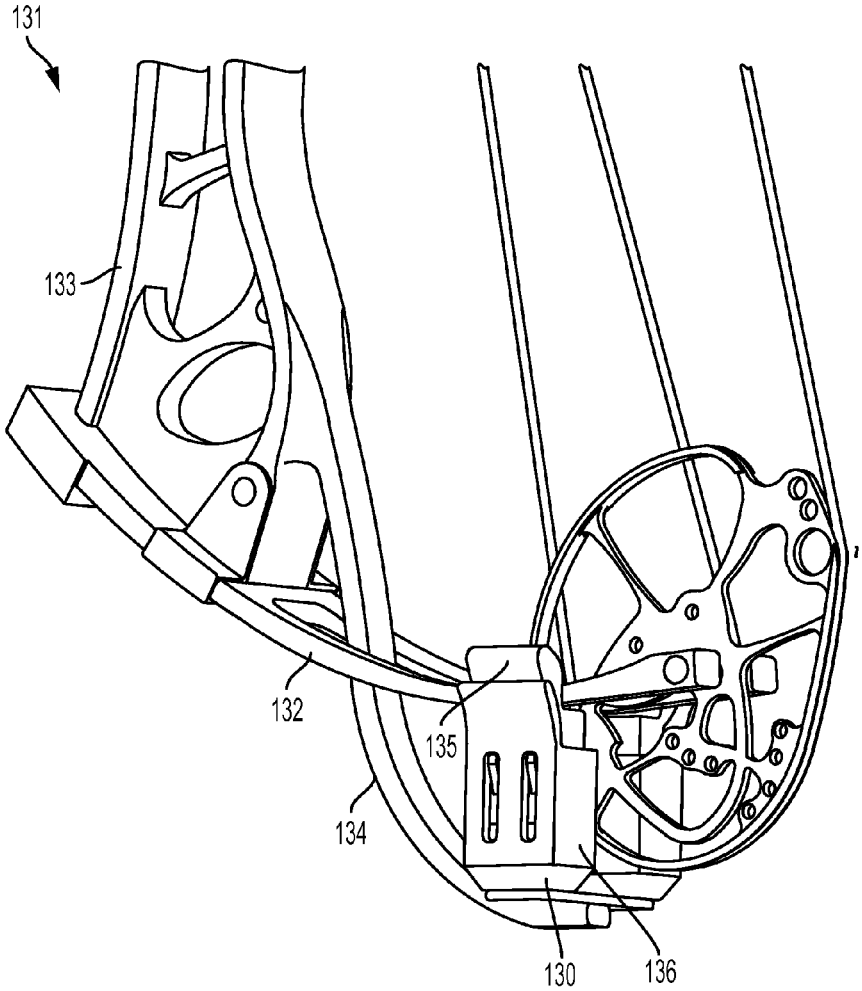
FIG. 15 is an enlarged fragmentary perspective view of the dampener of FIG. 13 mounted to the split limb compound bow.
Figure 16:
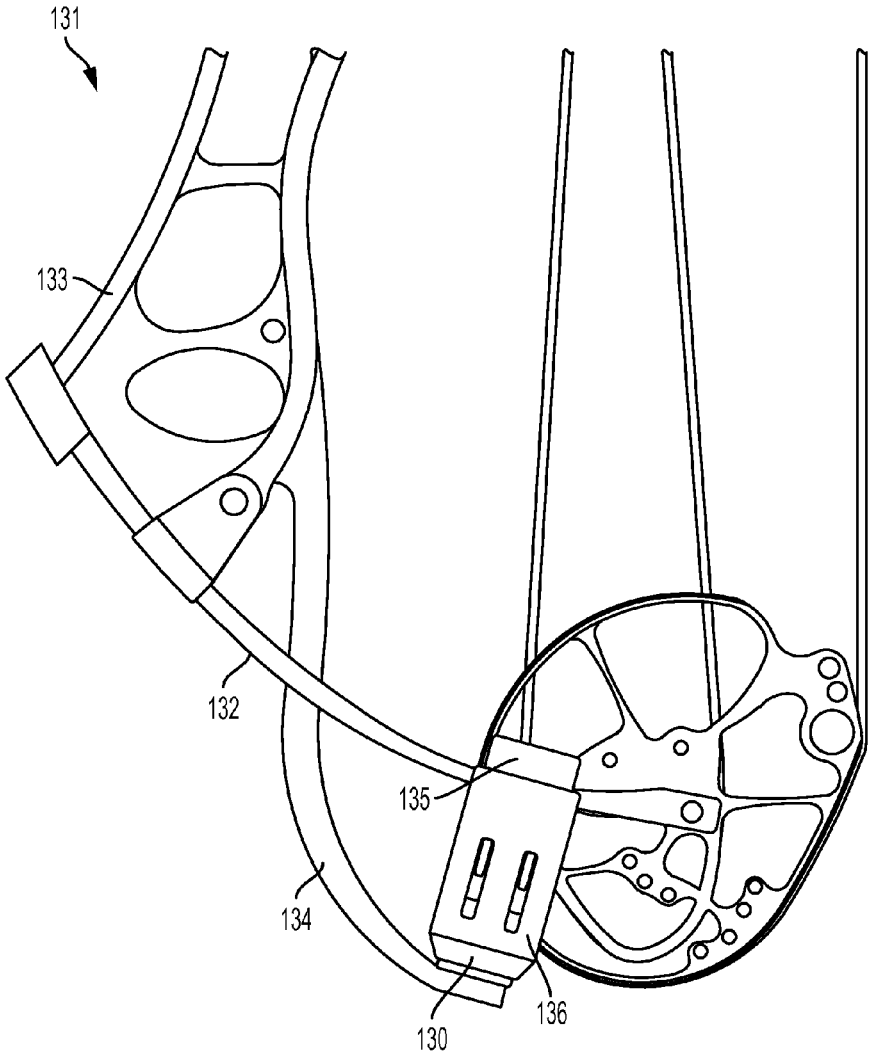
FIG. 16 is an enlarged fragmentary side view of the dampener of FIG. 13 mounted to the split limb compound bow.

In operation, as shown in FIGS. 2A-2C, dampener 1 of the first embodiment is positioned on the bow (not shown) using mounting rod 6. Preferably, dampener 1 is positioned on the bow such that bowstring 16 is disposed within groove 15 of grippers 12, and grippers 12 are in a closed position, with piston 3 disposed within sleeve 2, when bowstring 16 is in the "dead" or "static" (or "neutral") position (i.e., before bowstring 16 is drawn). In this manner, the position of bowstring 16 acts to bias piston 3 into sleeve 2 such that grippers 12 are maintained in closed position. FIG. 2C illustrates this position.

However, those skilled in the art will recognize that it is not necessary for bowstring 16 to be disposed within groove 15 of grippers 12 when bowstring 16 is in the "dead" or "static" (or "neutral") position (i.e., before bowstring 16 is drawn) and all such variations are included within the scope of the instant disclosure.

As shown in FIG. 2A, when bowstring 16 is drawn in preparation for a shot, bowstring 16 acts to pull piston 3 outwardly from sleeve 2 over a distance sufficient for grippers 12 to separate thereby releasing bowstring 16 from groove 15. Piston 3 preferably is prevented from fully withdrawing from sleeve 2 by the interaction of studs 13 and slots 11. However, in those embodiments of the bowstring sound dampener of the present invention that do not include studs 13 and slots 11, a slight frictional engagement between piston 3 and sleeve 2 can prevent piston 3 from fully withdrawing from sleeve 2 after bowstring 16 is released from groove 15.

As shown in FIG. 2B, once the drawn bowstring 16 is released, it travels between grippers 12 and is directed into groove 15. The force of bowstring 16 pushes piston 3 into sleeve 2, thereby causing grippers 12 to move toward one other and trapping bowstring 16 in groove 15, thereby deadening, dampening and silencing bowstring 16. Additionally, as discussed above, such inward movement of grippers 12 also can result from the impact or interaction of bowstring 16 with piston 3, the force of which may cause grippers 12 to move inwardly, towards one another, independent of the interaction between piston 3 and arms 10). Because dampener 1 preferably is positioned on the bow such that grippers 12 are in a closed position, as discussed above, when bowstring 16 is in the "dead" or "static" (or "neutral") position (i.e., before bowstring 16 is drawn), bowstring 16 acts to maintain grippers 12 in closed position.

FIGS. 13-25 illustrate various exemplary means and locations for mounting the claimed archery bow and bowstring dampener to a bow, particularly when the dampener is used to dampen the bow limb(s).

In FIGS. 13-16, dampener 130 (which, as illustrated, corresponds to the fourth embodiment of the claimed bow and bowstring dampener as further discussed below, but which could substituted with any of the embodiments of the claimed bow and bowstring dampener disclosed in the present application) is mounted to a split limb compound bow 131.

In the illustrated embodiment, dampener 130 is mounted to the lower portion of handle (or riser) 133 of compound bow 131 with a mounting bracket 134. Mounting bracket 134 is attached to rearward face of the lower portion of handle (or riser) 133 of compound bow 131 using bolts, screws and/or other means as are known in the art. Additionally, in some embodiments, mounting bracket 134 may be integral with the handle (or riser) 133 of compound bow 131. Similarly, mounting bracket 134 is attached to dampener 130 at the bottom end of dampener 130, again using bolts, screws and/or other means as are known in the art (but those skilled in the art will appreciate that bracket 134 may be attached to dampener 130 at other locations using other means). In some embodiments, mounting bracket 134 may be removably attached to handle (or riser) 133 and/or dampener 130.

Mounting bracket 134 is configured to position dampener 130 in a position in proximity to bow limb 132 of compound bow 131. As discussed above with respect to the positioning of dampener 1 with respect to bowstring 16, dampener 130 may be positioned in some embodiments such that bow limb 132 is in contact with piston 135 when bow limb 132 is the "static" (or "neutral" or "dead") position and in other embodiments such that bow limb 132 is not in contact with piston 135 when bow limb 132 is the "dead" or "static" (or "neutral") position. In either configuration, dampener 130 is disposed such that bow limb 132 impacts piston 135 after an arrow is shot, thereby forcing piston 135 into sleeve 136 causing bow limb(s) 132 to engage the gripper(s) as further discussed herein.

Figure 17:
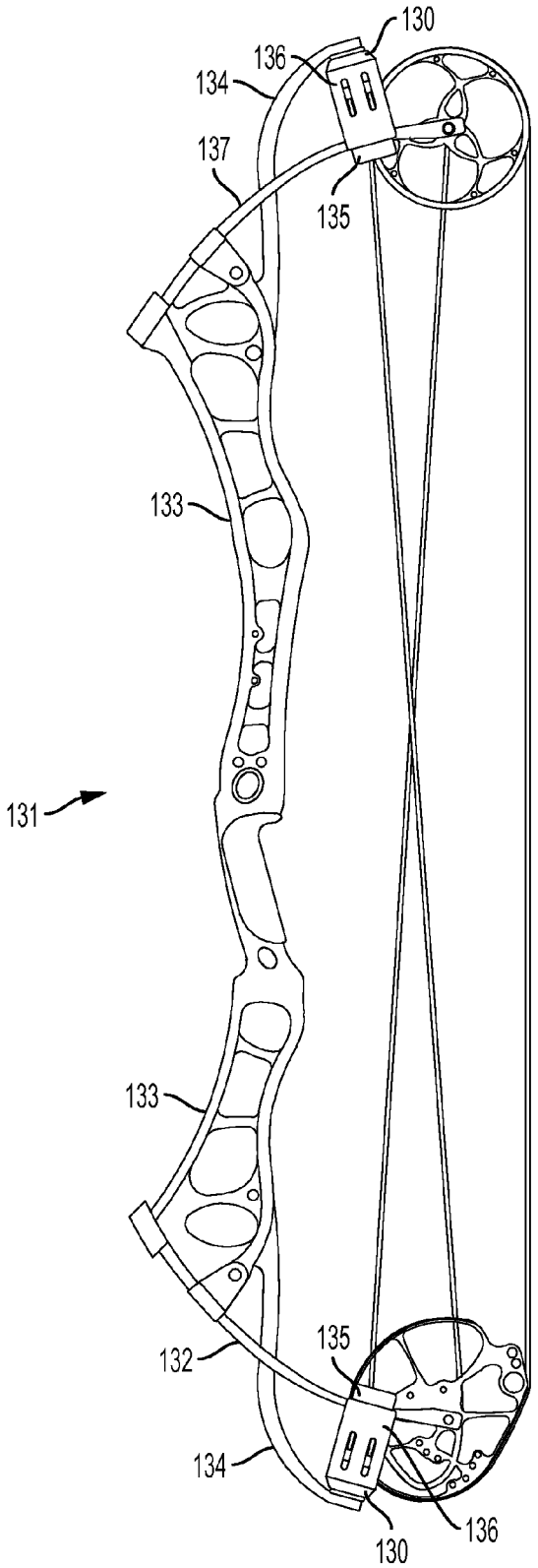
FIG. 17 is a side view of the dampener of FIG. 13 mounted to the top and bottom of the split limb compound bow.
Figure 18:
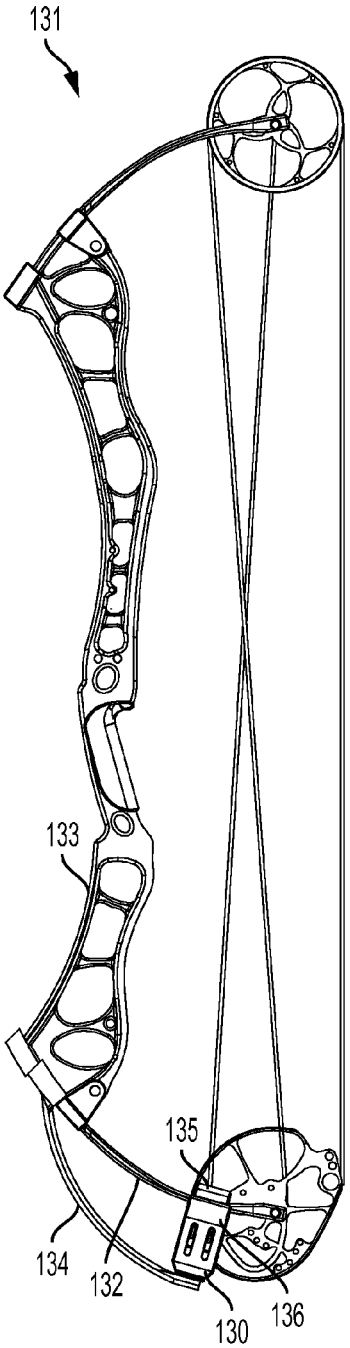
FIG. 18 is side view of an embodiment of a bow and bowstring dampener embodying the principles of the present invention as mounted to a split limb compound bow.
Figure 19:
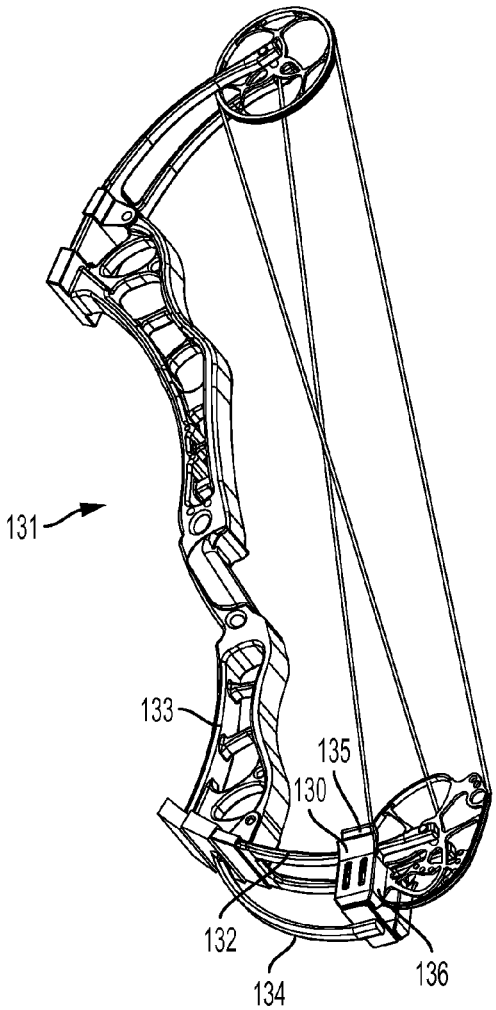
FIG. 19 is a perspective of the dampener of FIG. 18 mounted to the split limb compound bow.
Figure 20:
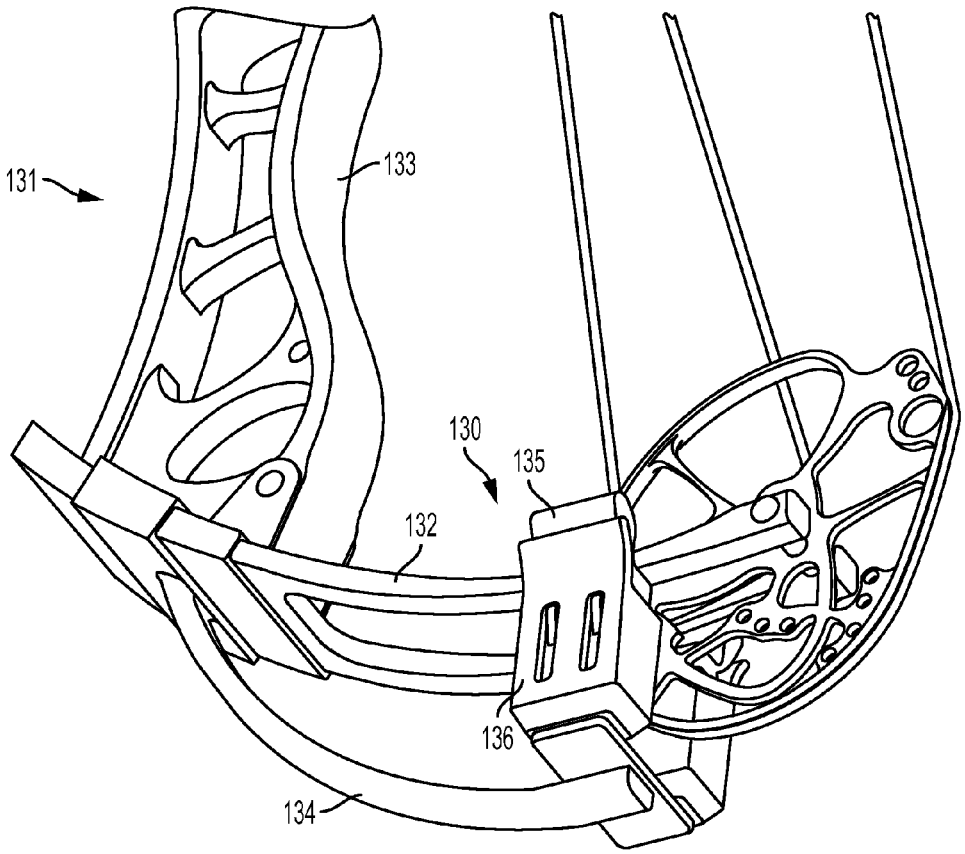
FIG. 20 is an enlarged fragmentary perspective view of the dampener of FIG. 18 mounted to the split limb compound bow.
Figure 21:
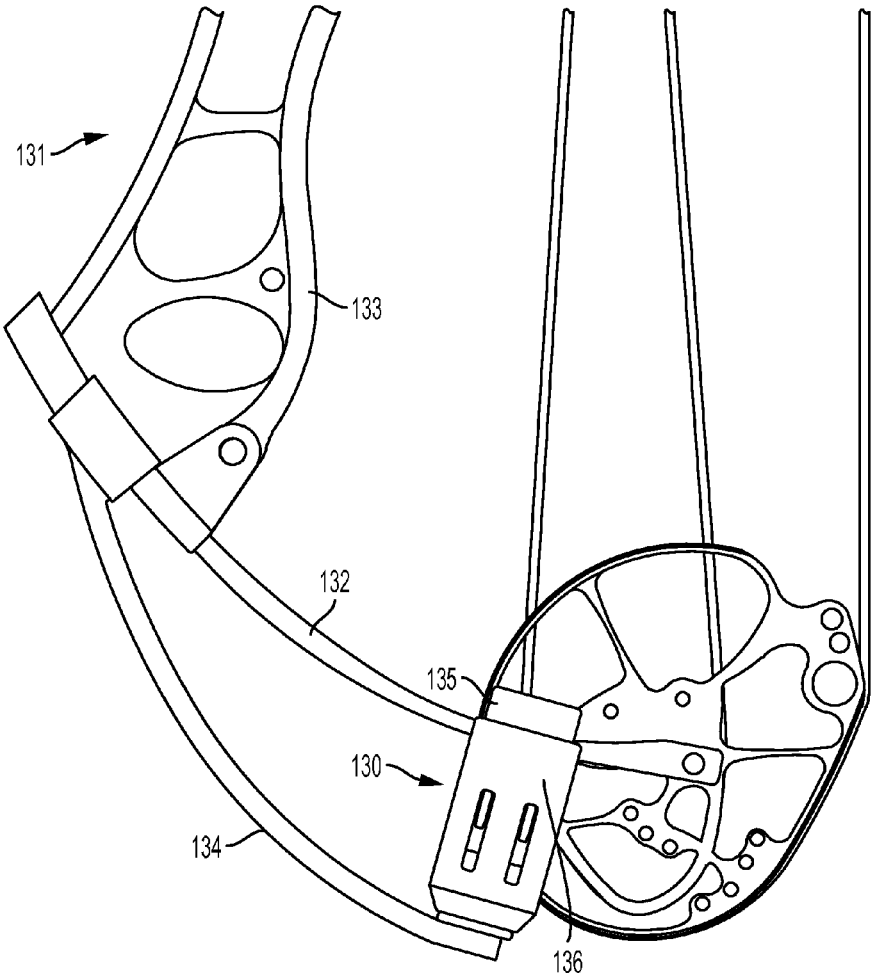
FIG. 21 is an enlarged fragmentary side view of the dampener of FIG. 18 mounted to the split limb compound bow.
Figure 22:
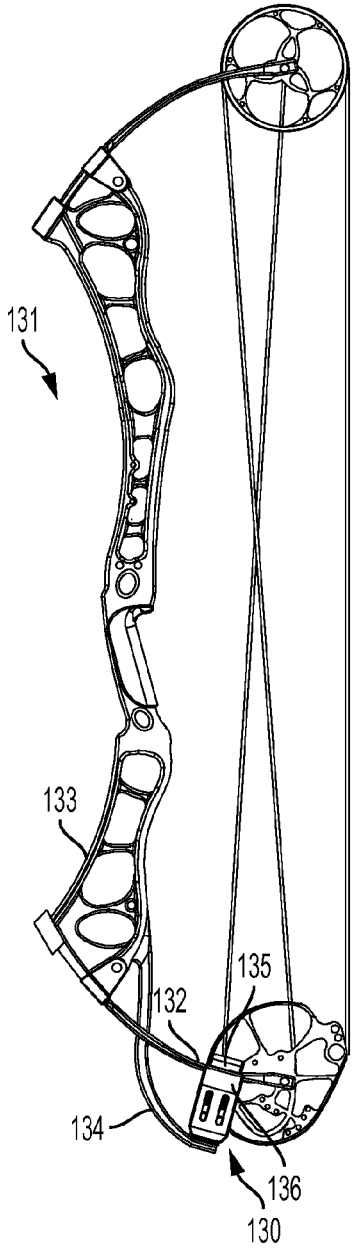
FIG. 22 is side view of an embodiment of a bow and bowstring dampener embodying the principles of the present invention as mounted to a split limb compound bow.
Figure 23:
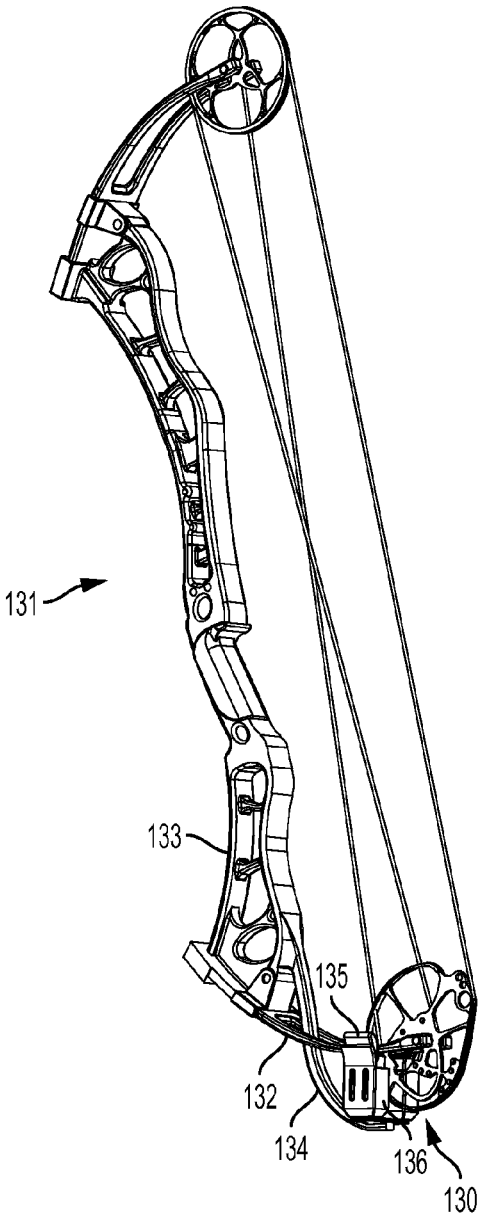
FIG. 23 is a perspective of the dampener of FIG. 22 mounted to the split limb compound bow.
Figure 24:
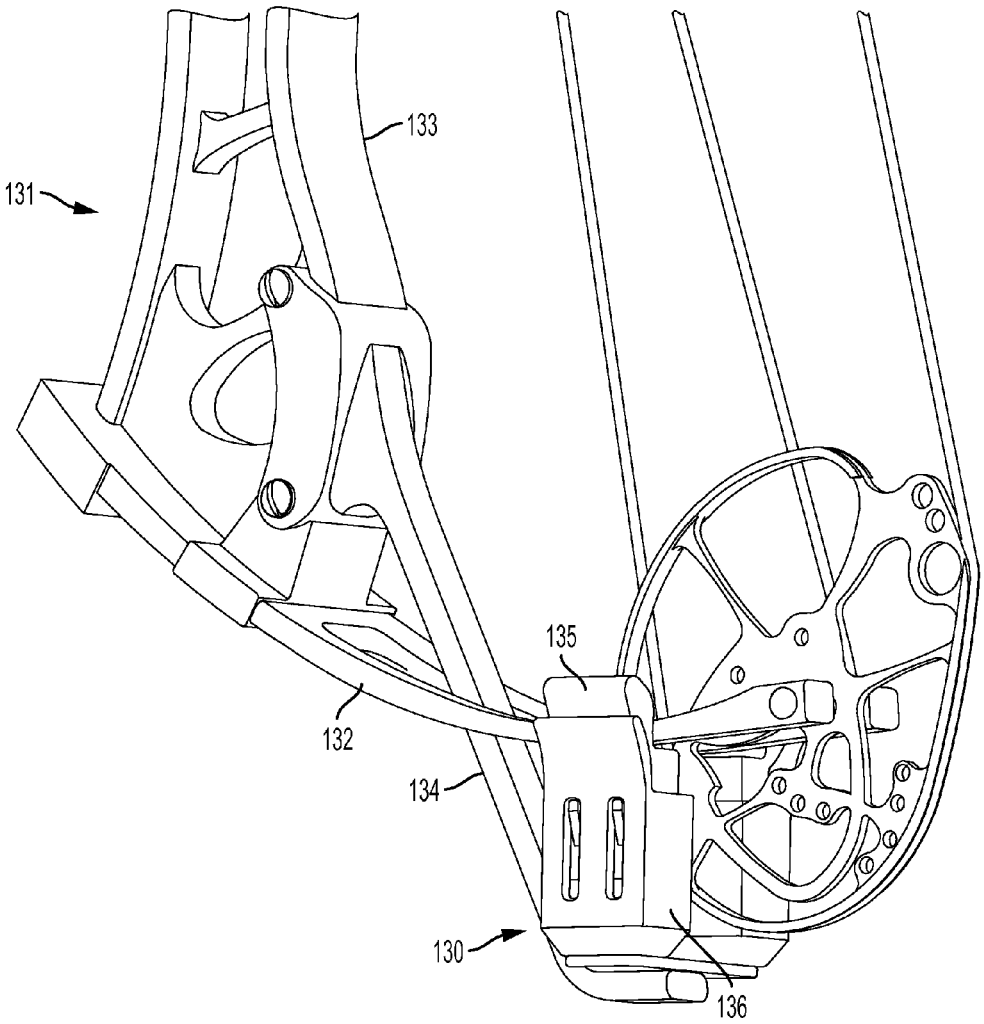
FIG. 24 is an enlarged fragmentary perspective view of the dampener of FIG. 22 mounted to the split limb compound bow.
Figure 25:
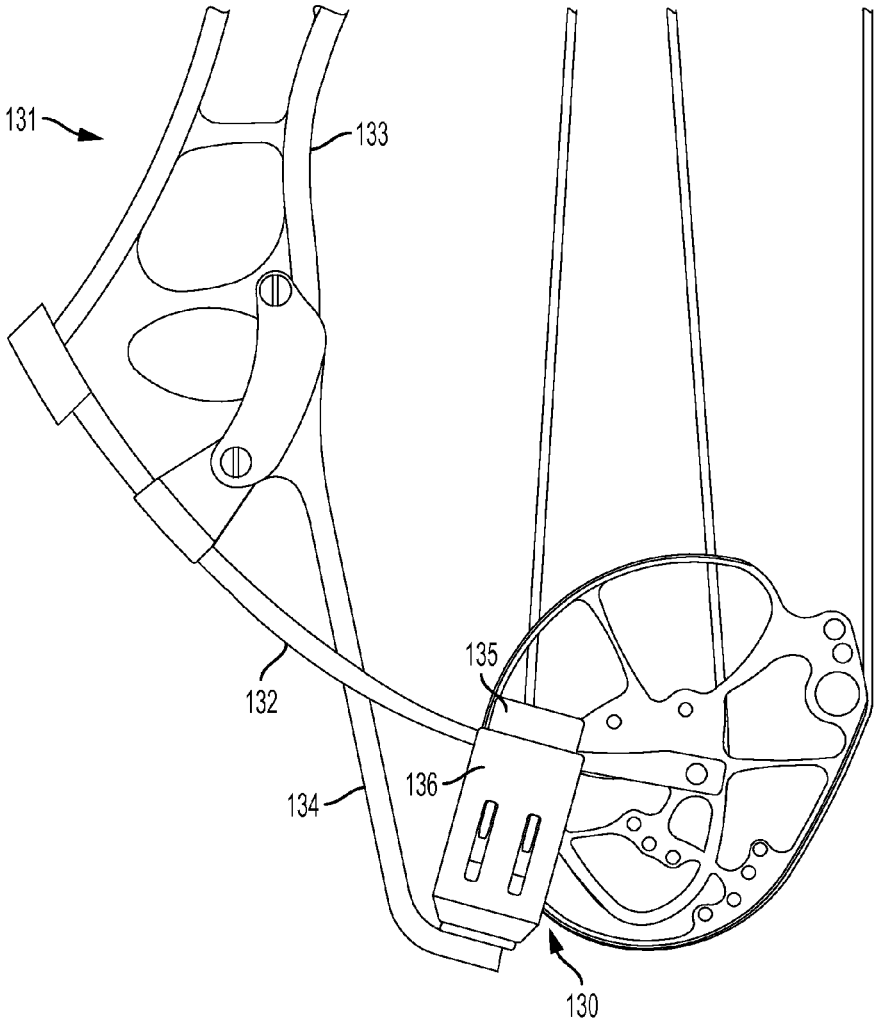
FIG. 25 is an enlarged fragmentary side view of the dampener of FIG. 22 mounted to the split limb compound bow.

As noted above, claimed bow and bowstring dampener may be disposed at various and at multiple locations on the bow. This includes, for example, mounting dampener 130 at the top and bottom of the bow as shown in FIG. 17. In FIG. 17, dampener 130 of FIGS. 13-16 and described above is mounted both to the bottom portion of handle (or riser) 133 of bow 131 using mounting bracket 134 but also to the top portion of handle (or riser) 133 in an identical manner. In this way, dampener 130 may advantageously serve to engage and dampen both the lower bow limb 132 and the upper bow limb 137.

Those skilled in the art will recognize the additional mounting positions and locations for dampener 130 are possible without departing from the scope of the instant disclosure and all such variations are included within the scope of the present invention, including without limitation the use of one, two or more dampeners at various locations.

FIGS. 18-21 illustrate dampener 130 (which, as illustrated, corresponds to the fourth embodiment of the dampener as further discussed below, but which could substituted with any of the embodiments of the claimed bow and bowstring dampener disclosed of the present application) as mounted to a split limb compound bow 131 in a different manner than as shown in FIGS. 13-16.

In the embodiment illustrated in FIGS. 18-21, dampener 130 is mounted to the bottom of handle (or riser) 133 of compound bow 131 using a mounting bracket 134. Mounting bracket 134 is attached to the bottom face of handle (or riser) 133 of compound bow 131 using bolts, screws and/or other means as are known in the art. Additionally, in some embodiments, mounting bracket 134 may be integral with the bottom of handle (or riser) 133 of compound bow 131. Similarly, mounting bracket 134 is attached to dampener 130 at the bottom end of dampener 130, again using bolts, screws and/or other means as are known in the art (but those skilled in the art will appreciate that bracket 134 may be attached to dampener 130 at other locations using other means). In some embodiments, mounting bracket 134 may be removably attached to handle (or riser) 133 and/or dampener 130.

Mounting bracket 134 is configured to position dampener 130 in a position in proximity to bow limb 132 of compound bow 131. As discussed above with respect to the positioning of dampener 1 with respect to bowstring 16, dampener 130 may be positioned in some embodiments such that bow limb 132 is in contact with piston 135 when bow limb 132 is the "static" (or "neutral" or "dead") position and in other embodiments such that bow limb 132 is not in contact with piston 135 when bow limb 132 is the "dead" or "static" (or "neutral") position. In either configuration, dampener 130 is disposed such that bow limb 132 impacts piston 135 after an arrow is shot, thereby forcing piston 135 into sleeve 136 causing bow limb(s) 132 to engage the gripper(s) as further discussed herein.

In the embodiment illustrated in FIGS. 22-25, dampener 130 is mounted to the bottom of handle (or riser) 133 of compound bow 131 using a different style mounting bracket 134. In this embodiment, mounting bracket 134 is attached to the rearward face of the bottom portion of handle (or riser) 133 of compound bow 131 using bolts, screws and/or other means as are known in the art. Additionally, in some embodiments, mounting bracket 134 may be integral with the bottom portion of handle (or riser) 133 of compound bow 131. Similarly, mounting bracket 134 is attached to dampener 130 at the bottom end of dampener 130, again using bolts, screws and/or other means as are known in the art (but those skilled in the art will appreciate that bracket 134 may be attached to dampener 130 at other locations using other means). In some embodiments, mounting bracket 134 may be removably attached to handle (or riser) 133 and/or dampener 130.

As in the prior embodiments, mounting bracket 134 is configured to position dampener 130 in a position in proximity to bow limb 132 of compound bow 131. As discussed above with respect to the positioning of dampener 1 with respect to bowstring 16, dampener 130 may be positioned in some embodiments such that bow limb 132 is in contact with piston 135 when bow limb 132 is the "static" (or "neutral" or "dead") position and in other embodiments such that bow limb 132 is not in contact with piston 135 when bow limb 132 is the "dead" or "static" (or "neutral") position. In either configuration, dampener 130 is disposed such that bow limb 132 impacts piston 135 after an arrow is shot, thereby forcing piston 135 into sleeve 136 causing bow limb(s) 132 to engage the gripper(s) as further discussed herein.

Figure 26:
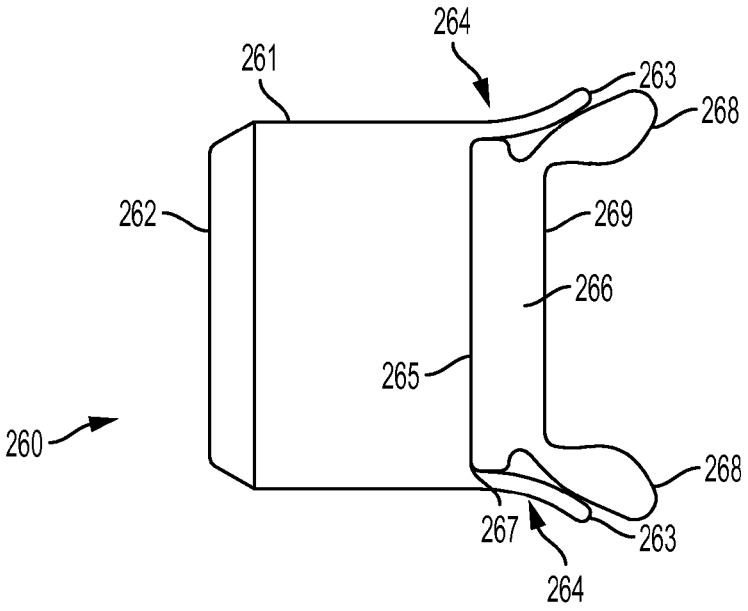
FIG. 26 is a top view of the second embodiment of a bow and bowstring dampener embodying the principles of the present invention.

As shown in FIG. 26, a second embodiment of the claimed archery bow and bowstring dampener 260 is particularly useful for dampening bow limbs (but also is adaptable to dampen bowstrings). Dampener 260 comprises a sleeve 261 that generally is rectangular in shape with a generally flat first end 262 adapted to attach to a mounting bracket (such as mounting bracket 134, discussed above) for connecting dampener 260 to a bow (not shown).

Sleeve 261 comprises a second end 264 which is flared outwardly with a pair of generally rectangularly shaped grooves 265 (only one such groove 265 is visible in FIG. 26) formed on opposing sides of sleeve 261 thereby creating a pair of opposed arms 263. Sleeve 261 is configured to matingly receive a piston 266 in a cavity 267 formed therein. In this second embodiment, sleeve 261 preferably is a comprised of a rigid, lightweight material, such as aluminum, plastic or other materials known in the art.

In this second embodiment of dampener 260, piston 266 is formed as a generally rectangular box-shaped member having a pair of grippers 268 extending therefrom on one end. Piston 266 preferably is formed of a resilient material capable of holding its shape, but also capable of absorbing the force of the bow limb(s) cushioning or deadening the movement of the bow limb(s). Such material may include various rubbers or elastomers as are well known to those skilled in the art.

Grippers 268 flare outwardly from piston 266 in an opposed configuration. A groove 269 is formed between grippers 268, groove 269 being configured to receive and retain the bow limb(s) (not shown) after the arrow is released. Grippers 268 are flexibly or pivotally mounted on piston 266 such that grippers 268 may move inwardly, towards one another, when the bow limb(s) (not shown) impact or interact with piston 266 and piston 266 enters sleeve 261 (as described generally above with respect to the first embodiment of the claimed bow and bowstring dampener engaging the bowstring). Grippers 268 preferably are biased outwardly, such that grippers 268 move outwardly, away from one other, when piston 266 exits sleeve 261.

Although not shown in FIG. 26, it will be appreciated by those skilled in the art that sleeve 261 may include a slot (or slots) for receiving a mating stud (or studs) formed on piston 266. The slot(s) and stud(s) may advantageously be used to control and/or limit movement of piston 266 within sleeve 261 (in the same manner as described generally above with respect to the first embodiment of the claimed bow and bowstring dampener).

It also will be appreciated by those skilled in the art that dampener 260 of this embodiment of the present invention may be mounted to the bow in any suitable location, including on the handle (or riser), the bow limb(s) or in any other locations or manners such that dampener 260 lies in the path of the bow limb(s) after the arrow is released. This may include movable attachment means whereby dampener 260 initially is disposed outside of the path of the bow limb(s) before the arrow is released, but is moved into the path of the bow limb(s) after the arrow is released. This also may include mounting multiple dampeners 260 at various locations to engage multiple bow limbs at multiple locations.

It will be appreciated by those skilled in the art that the shape (or geometry) of sleeve 261, piston 266, grippers 268 and/or grooves 269 may vary depending on the geometry of the bow limb(s) and all such variations are included within the scope of the present disclosure.

Figure 27:
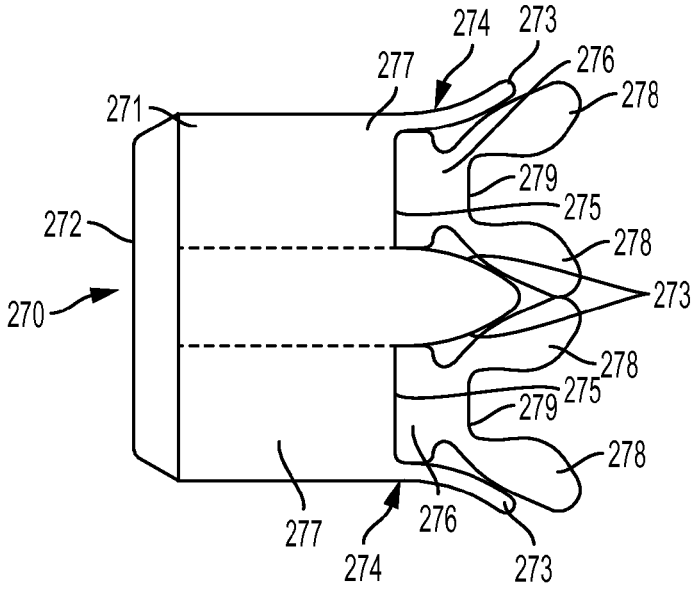
FIG. 27 is a top view of the third embodiment of a bow and bowstring dampener embodying the principles of the present invention.

As shown in FIG. 27, a third embodiment of the claimed archery bow and bowstring dampener 270 also is particularly useful for dampening bow limbs (but also adaptable to dampen bowstrings). Dampener 270 comprises a sleeve 271 that generally is rectangular in shape with a generally flat first end 272 adapted to attach to a mounting bracket (such as mounting bracket 134, discussed above) for connecting dampener 270 to a bow (not shown).

Unlike the first and second embodiments of the bow and bowstring dampener of the present invention, in which the sleeve comprises a single cavity 267 in which a single piston is disposed, sleeve 271 in this third embodiment comprises two integrated cavities 277 (indicated by the dotted lines in FIG. 27) in which two pistons 276 are disposed (particularly useful for split limb bows).

Each cavity 277 of sleeve 271 is flared outwardly at a second end 274 of sleeve 271, with a pair of generally rectangularly shaped grooves 275 (only two such grooves 275 are visible in FIG. 27) formed on opposing sides of each cavity 277 thereby creating two pairs of opposed arms 273. Sleeve 271 is configured to matingly receive two pistons 276 in the cavities 277 formed therein. In this second embodiment, sleeve 271 preferably is a comprised of a rigid, lightweight material, such as aluminum, plastic or other materials known in the art.

In this third embodiment of dampener 270, pistons 276 are formed as generally rectangular box-shaped members having a pair of grippers 278 extending therefrom on one end. Pistons 276 preferably are formed of a resilient material capable of holding its shape, but also capable of absorbing the force of the bow limb(s) cushioning or deadening the movement of the bow limb(s). Such material may include various rubbers or elastomers as are well known to those skilled in the art.

Grippers 278 flare outwardly from pistons 276 in an opposed configuration. Grooves 279 are formed between grippers 278, grooves 279 being configured to receive and retain the bow limbs (not shown) of a split bow after the arrow is released. Grippers 278 are flexibly or pivotally mounted on pistons 276 such that grippers 278 may move inwardly, towards one another, when pistons 276 enter cavities 277 of sleeve 271 to engage the bow limbs (as described generally above with respect to the first and second embodiment of the claimed bow and bowstring dampener). Grippers 278 preferably are biased outwardly, such that grippers 278 move outwardly, away from one other, when pistons 276 exit cavities 277 of sleeve 271.

Although not shown in FIG. 26, it will be appreciated by those skilled in the art that sleeve 261 may include a slot (or slots) for receiving a mating stud (or studs) formed on piston 266. The slot(s) and stud(s) may advantageously be used to control and/or limit movement of piston 266 within sleeve 261 (as discussed above with respect to the first embodiment of the claimed bow and bowstring dampener).

It also will be appreciated by those skilled in the art that dampener 270 of this embodiment may be mounted to the bow in any suitable location, including on the handle (or riser), the bow limbs or in any other locations or manners such that dampener 270 lies in the path of the bow limbs after the arrow is released. This may include movable attachment means whereby dampener 270 is initially disposed outside of the path of the bow limbs before the arrow is released, but is moved into the path of the bow limbs after the arrow is released. This also may include mounting multiple dampeners 270 at various locations to engage multiple bow limbs at multiple locations.

It also will be appreciated by those skilled in the art that the shape of sleeve 271, pistons 276, grippers 278 and/or grooves 279 may vary depending on the shape and geometry of the bow limbs and all such variations are included within the scope of the present disclosure.

Figure 28:
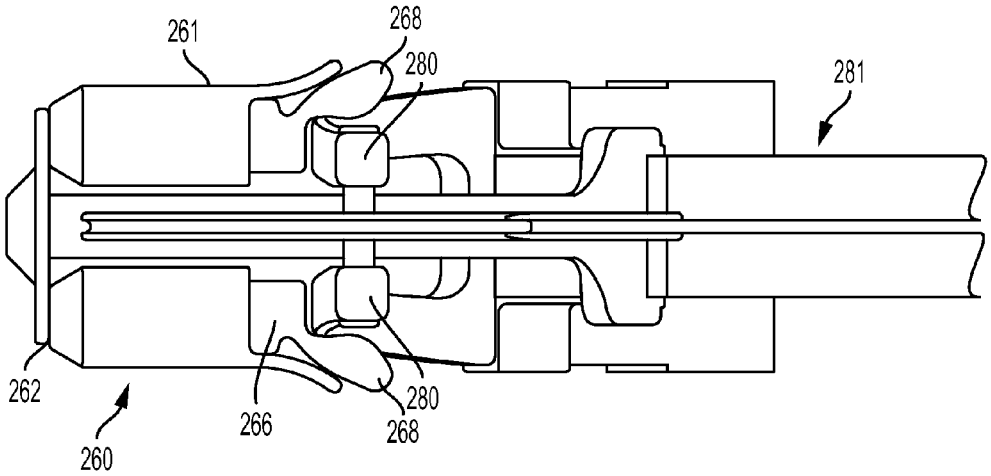
FIG. 28 is a fragmentary top view of the second embodiment of a bow and bowstring dampener embodying the principles of the present invention attached to a split limb compound bow and prepared to engage the bow limbs.

In FIG. 28, the second embodiment of the archery bow and bowstring dampener 260 of the present invention is shown mounted to an archery bow 281. In the illustrated view, split limbs 280 of bow 281 are disposed in proximity to piston 266 and grippers 268 are in an open position prepared to engage split limbs 280 of bow 281. After an arrow is released, split limbs 280 of bow 281 will move toward piston 266, engaging piston 266 and forcing it into sleeve 261. The impact and interaction of split limbs 280 with piston 266 (and the failsafe interaction of grippers 268 with arms 263) causes grippers 268 to move inwardly towards one another and captures split limbs 280 in grippers 268 to dampen the movement and sound of split limbs 280.

Figure 29:
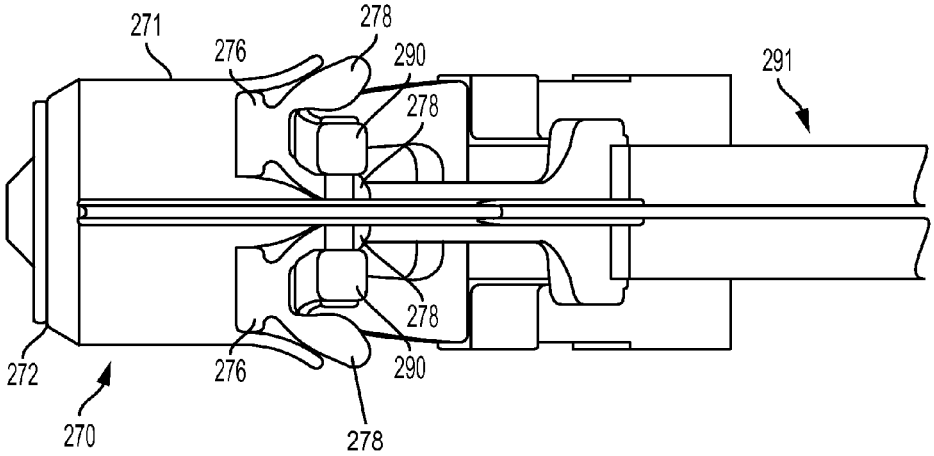
FIG. 29 is a fragmentary top view of the third embodiment of a bow and bowstring dampener embodying the principles of the present invention attached to a split limb compound bow and prepared to engage the bow limbs.

In FIG. 29, the third embodiment of the claimed archery bow and bowstring dampener 270 is shown mounted to an archery bow 291. In the illustrated view, split limbs 290 of bow 291 are disposed in proximity to pistons 276 and grippers 278 are in an open position prepared to engage split limbs 290 of bow 291. After an arrow is released, split limbs 290 of bow 291 will move toward pistons 276, engaging pistons 276 and forcing them into cavities 277 of sleeve 271. The impact and interaction of split limbs 290 with pistons 276 (and the failsafe interaction of grippers 278 with arms 273) causes grippers 278 to move inwardly towards one another and capture split limbs 290 in grippers 278 to dampen the movement and sound of split limbs 290.

A fourth embodiment of the claimed archery bow and bowstring dampener is illustrated in FIGS. 30-33. In this embodiment, dampener 300 comprises two discreet sleeves 301 disposed at a distance from one another (particularly useful with split limb bows). Each sleeve 301 generally is rectangular in shape with a first end 302 adapted to attach to a mounting bracket (as discussed above with respect to other embodiments of the claimed archery bow and bowstring dampener) for connecting dampener 300 to a bow. Each of the sleeves 301 is flared outwardly at one side 303 of the second end of the sleeve 301 thereby creating an arm 304 on each sleeve 301.

Each sleeve 301 is configured to matingly receive a piston 305 in a cavity 306 formed therein. In this fourth embodiment, sleeve 301 preferably is a comprised of a rigid, lightweight material, such as aluminum, plastic or other materials known in the art.

In this fourth embodiment of dampener 300, each piston 305 is formed as a generally rectangular box-shaped member having a single gripper 307 extending therefrom on one end. Piston 305 preferably is formed of a resilient material capable of holding its shape, but also capable of absorbing the force of the bow limbs cushioning or deadening the movement of the bow limbs. Such material may include various rubbers or elastomers as are well known to those skilled in the art.

Each gripper 307 flares outwardly from pistons 305. A surface 308 is formed along the top edge of each piston 305 adjacent to gripper 307, surface 308 being configured to engage bow limbs 309 after the arrow is released. Grippers 307 are flexibly or pivotally mounted on pistons 305 such that grippers 307 may move inwardly, towards one another, when the pistons 305 engage the bow limbs and enter the cavities 306 of sleeves 301 (as described generally above with respect to the other embodiments of the claimed bow and bowstring dampener). Grippers 307 preferably are biased outwardly, such that grippers 307 move outwardly, away from one other, when pistons 305 exit the cavities 306 of sleeves 301.

Although not shown in FIGS. 30-33, it will be appreciated by those skilled in the art that sleeves 301 may include a slot (or slots) for receiving a mating stud (or studs) formed on pistons 305. The slot(s) and stud(s) may advantageously be used to control and/or limit movement of pistons 305 within sleeves 301 (as discussed above with respect to the first embodiment of the claimed bow and bowstring dampener).

It also will be appreciated by those skilled in the art that dampener 300 of this embodiment of the claimed bow and bowstring dampener may be mounted to the bow in any suitable location, including on the handle (or riser), the bow limbs or in any other locations or manners such that dampener 300 lies in the path of the bow limbs after the arrow is released. This may include movable attachment means whereby dampener 300 is initially disposed outside of the path of the bow limbs before the arrow is released, but is moved into the path of the bow limbs after the arrow is released. This also may include mounting multiple dampeners 300 at various locations to engage multiple bow limbs at multiple locations.

It will be appreciated by those skilled in the art that the shape and geometry of sleeves 301, pistons 305, grippers 307 and/or surface 306 may vary depending on the geometry of the bow limb(s) and all such variations are included within the scope of the present disclosure.

Figure 30:
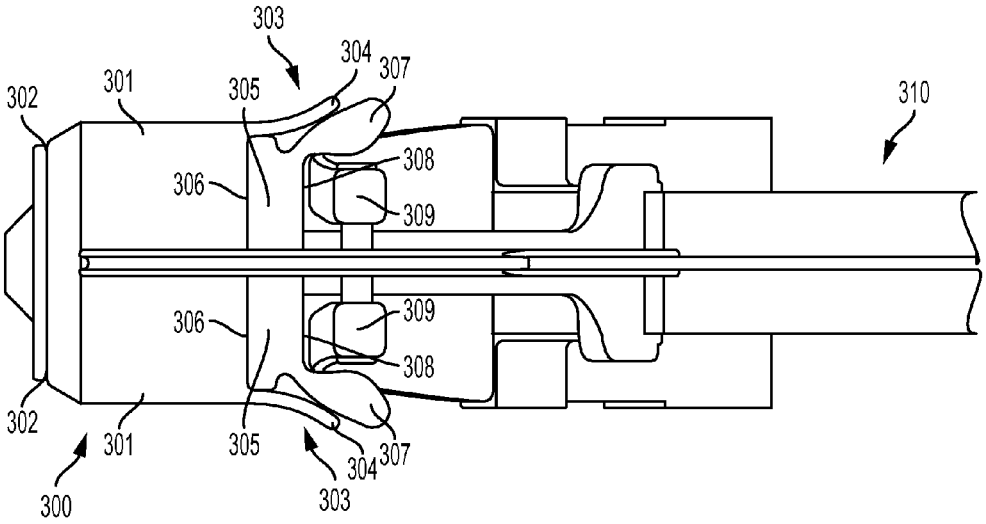
FIG. 30 is a fragmentary top view of the fourth embodiment of a bow and bowstring dampener embodying the principles of the present invention attached to a split limb compound bow and prepared to engage the bow limbs.
Figure 31:
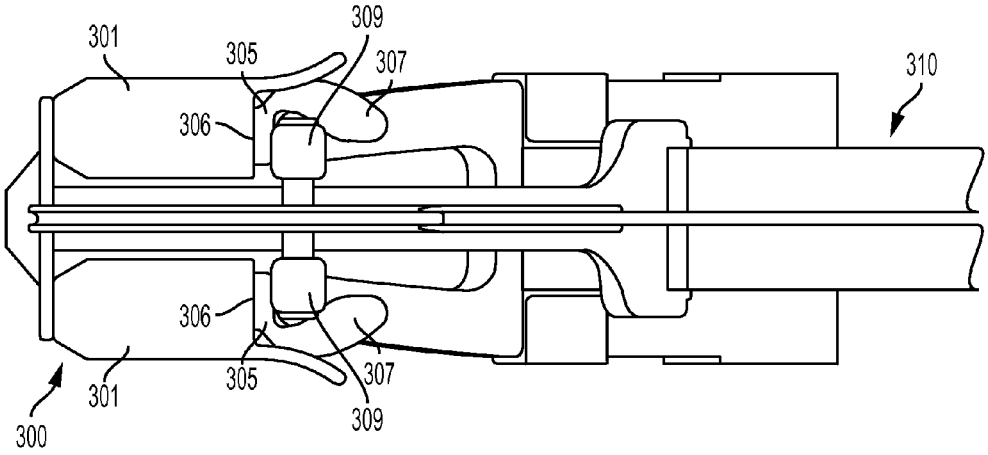
FIG. 31 is fragmentary top view of the fourth embodiment of the bow and bowstring dampener of FIG. 30 engaging the bow limbs.
Figure 32:
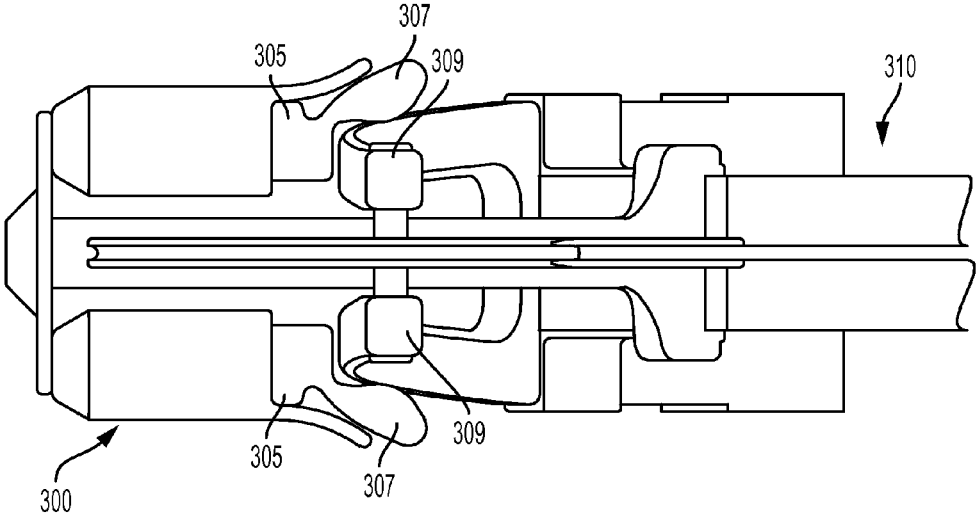
FIG. 32 is a fragmentary top view another version of the fourth embodiment of a bow and bowstring dampener embodying the principles of the present invention attached to a split limb compound bow and prepared to engage the bow limbs; and, FIG. 33 is fragmentary top view of the fourth embodiment of the bow and bowstring dampener of FIG. 32 engaging the bow limbs.

FIGS. 30-33 illustrate the fourth embodiment of the claimed archery bow and bowstring dampener 300 in various operating positions. In FIGS. 30 and 32, the fourth embodiment of the claimed archery bow and bowstring dampener 300 is shown mounted to an archery bow 301. In the illustrated view, split limbs 309 of bow 310 are disposed in proximity to pistons 305 and grippers 307 are in an open position prepared to engage split limbs 309 of bow 310.

Figure 33:
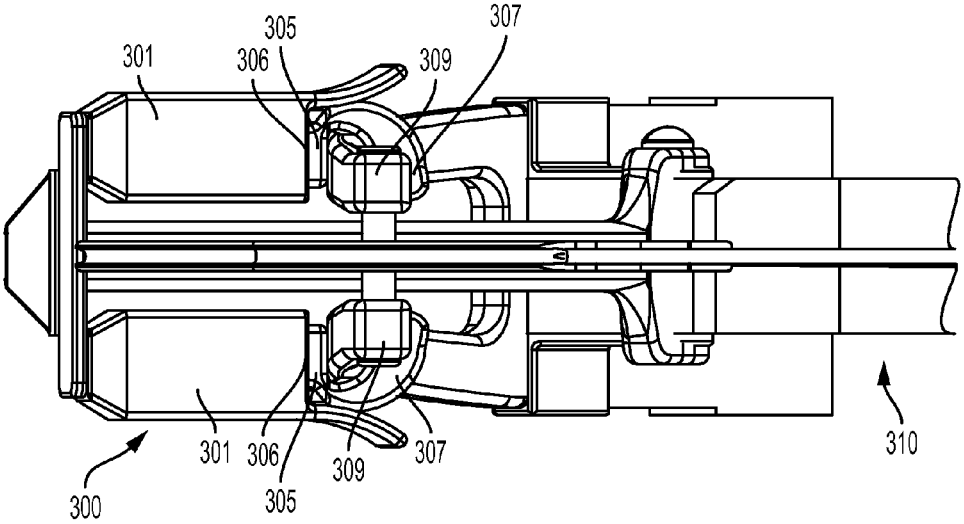

As shown in FIGS. 31 and 33, after an arrow is released, split limbs 309 of bow 310 have moved toward pistons 305, engaging pistons 305 and forcing them into cavities 306 of sleeves 301. The impact or interaction between split limbs 309 and pistons 305 (and the failsafe of the interaction of pistons 305 with the arms of the sleeves 301) cause grippers 307 to move inwardly towards one another and capturing split limbs 309 in grippers 307 to dampen the movement and sound of split limbs 309, in a manner similar to that discussed above with respect to the other embodiments of the claimed bow and bowstring dampener.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A bow and bowstring dampener, the dampener comprising:

at least one sleeve, the at least one sleeve comprising a first sleeve end and a second sleeve end, the second sleeve end having at least one arm;

at least one piston, the at least one piston matingly received inside the at least one sleeve and comprising at least one outwardly biased gripper extending therefrom, the at least one outwardly biased gripper flared outwardly;

wherein, in response to interaction by a bow limb, the at least one gripper at least partially surrounds the at least one bow limb.

2. The dampener of claim 1 wherein the first sleeve end of the at least one sleeve is configured to engage a mounting bracket to connect the dampener to a bow.

3. The dampener of claim 1 where in the first sleeve end of the at least one sleeve is generally flat.

4. The dampener of claim 1 wherein the at least one sleeve is generally rectangular.

5. The dampener of claim 1 wherein the at least one arm of the second sleeve end is flared outwardly.

6. The dampener of claim 1 wherein the at least one arm comprises two arms are the arms are flared outwardly from one another.

7. The dampener of claim 1 wherein the at least one piston further comprises a groove configured to receive the at one bow limb.

8. The dampener of claim 7 wherein the groove is formed adjacent to the at least one outwardly biased gripper.

9. The dampener of claim 1 wherein the at least one piston further comprises a surface configured to engage the at one bow limb.

10. The dampener of claim 1 wherein the at least one sleeve further comprises at least one slot and the at least one piston further comprises at least one stud configured to engage the at least one slot to control movement of the at least one piston within the at least one sleeve.

11. The dampener of claim 1 wherein the at least one bow limb is a split bow limb.

12. The dampener of claim 11 wherein the at least one gripper comprises a pair of grippers configured to engage each bow limb of the split bow.

13. The dampener of claim 1 where the at least one gripper is formed with a curved profile.

14. The dampener of claim 1 wherein the at least one gripper at least partially surrounds the at least one bow limb as a result of an impact force exerted by the at least one bow limb.

15. The dampener of claim 1 wherein the at least one gripper at least partially surrounds the at least one bow limb as a result of an interaction between the at least one gripper and the at least one arm of the at least one sleeve.

16. The dampener of claim 1 wherein the dampener is mounted to a bow riser.

17. The dampener of claim 16 wherein the dampener is mounted to a rearward face of the bow riser.

18. The dampener of claim 1 wherein the at least one gripper is configured to move inwardly towards the at least one bow limb when the at least one piston moves into the at least one sleeve and to move outwardly away from the at least one bow limb when the at least one piston moves out of the at least one sleeve.

19. The dampener of claim 1 wherein the dampener is configured to be set off from a bow at a plurality of distances.

20. The dampener of claim 1 wherein the at least one bow limb is in contact with the at least one piston when the at least at least one bow limb is in a “dead” or “static” position.

* * * * *